US005832349A

United States Patent [19]

Nagashima

[11] Patent Number: 5,832,349

[45] Date of Patent: Nov. 3, 1998

[54] TONER REPLENISHING CONTAINER WITH UNIDIRECTIONAL TEAR OPENING FEATURE

[75] Inventor: Toshiaki Nagashima, Mishima, Japan

[73] Assignee: Canon Kabshiki Kaisha, Tokyo, Japan

[21] Appl. No.: 824,351

[22] Filed: Mar. 25, 1997

[30] Foreign Application Priority Data

Mar. 27, 1996 [JP] Japan ..... 8-097722

[51] Int. Cl.[6] ..... G03G 15/08

[52] U.S. Cl. ..... 399/262; 141/364; 206/532; 383/206; 493/212

[58] Field of Search ..... 399/106, 258, 399/262; 206/532; 383/206; 493/212; 222/DIG. 1; 141/364

[56] References Cited

U.S. PATENT DOCUMENTS

| | | | |
|---|---|---|---|
| 5,094,863 | 3/1992 | Vandenburg | 426/115 |
| 5,177,540 | 1/1993 | Honda et al. | 399/106 |
| 5,184,896 | 2/1993 | Hammond et al. | 383/33 |
| 5,337,126 | 8/1994 | Michlin | 399/262 |
| 5,593,068 | 1/1997 | Kitayama et al. | 222/167 |
| 5,649,270 | 7/1997 | Omata et al. | 399/262 |
| 5,655,181 | 8/1997 | Chafani et al. | 399/114 |

FOREIGN PATENT DOCUMENTS

| | | |
|---|---|---|
| 4-66980 | 3/1992 | Japan . |

*Primary Examiner*—Joan H. Pendegrass

*Attorney, Agent, or Firm*—Fitzpatrick, Cella, Harper & Scinto

[57] ABSTRACT

The present ivention provides a toner replenishing container comprising a bag made of a film, and an opening member for opening the bag by tearing it. After the unsealing, a bottom of the bag is completely opened.

12 Claims, 7 Drawing Sheets

TONER REPLENISHING CONTAINER WITH UNIDIRECTIONAL TEAR OPENING FEATURE

BACKGROUND OF THE INVENTION

1. Field of the Invention

The present invention relates to a toner replenishing or supplementing container for replenishing toner to a developing device used in an electrophotographic image forming apparatus such as an electrostatic copying machine, printer and the like.

2. Related Background Art

In the past, powder has been used in electrophotographic image forming apparatuses such as electrostatic copying machines, printers and the like. In order to replenish the toner to a developing device of the image forming apparatus, a toner replenishing container has been constituted by a cylindrical or prismatic main body made of synthetic resin or the like, and a seal member for sealing an opening of the main body through which powder toner is replenished from the main body to the developing device.

Further, there have been proposed toner replenishing containers using plastic or aluminium bags.

SUMMARY OF THE INVENTION

An object of the present invention is to provide a toner replenishing container which can improve a sealing ability.

Another object of the present invention is to provide a toner replenishing container in which a toner discharging ability is improved.

A further object of the present invention is to provide a toner replenishing container in which an opening for a bag is formed in a bottom of the bag.

The other object of the present invention is to provide a toner replenishing container in which a bag can be opened completely.

DETAILED DESCRIPTION OF THE PREFERRED EMBODIMENTS

The present invention will now be explained in connection with embodiments thereof with reference to the accompanying drawings.

(First Embodiment)

Figure 1:
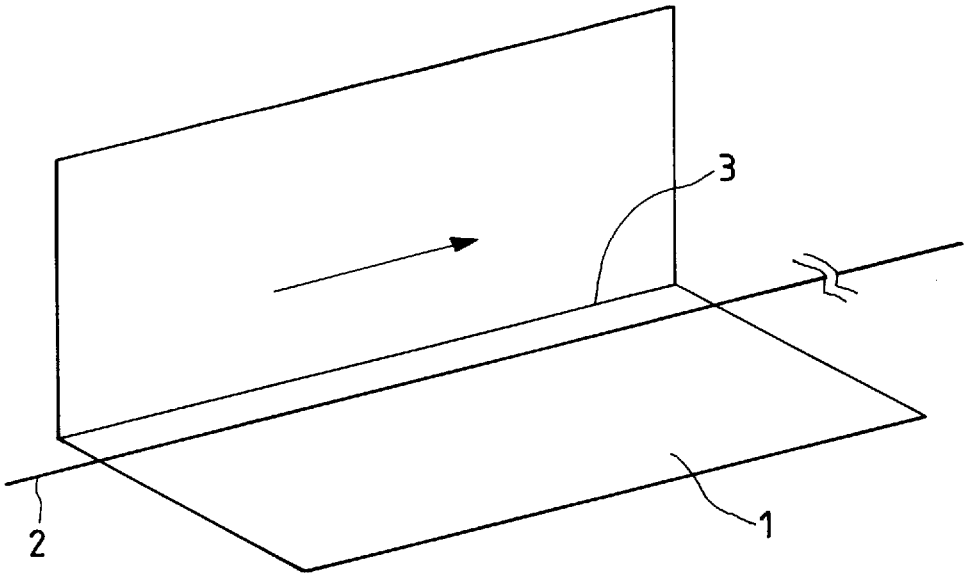
FIG. 1 is a perspective view showing manufacturing steps of a toner replenishing container according to a first embodiment of the present invention.
Figure 2:
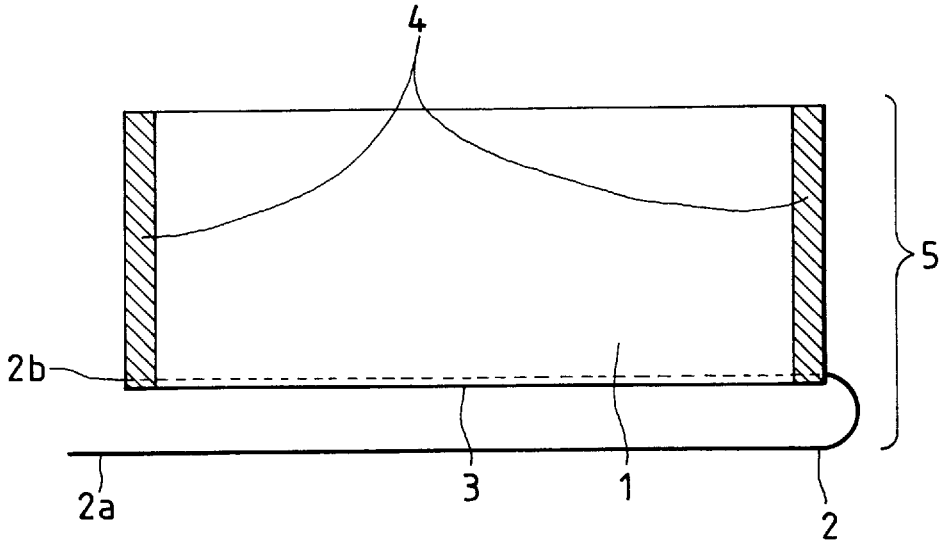
FIG. 2 is a plan view showing a construction of the toner replenishing container according to the first embodiment.

FIGS. 1 and 2 are perspective and plan views, respectively, showing a toner replenishing container which is being assembled. The toner replenishing container according to a first embodiment of the present invention is constituted by a film 1 forming a bag-shaped container body, and a thread 2 used as an opening or unsealing member.

Next, assembling steps for the toner replenishing container according to the first embodiment will be explained. The film 1 includes a heat-fusible layer and a unidirectional ductile layer. As shown in FIG. 1, the film 1 is cut to a rectangular shape, and the rectangular film is folded into two to form a straight fold line acting as a tear line 3. The unsealing thread 2 is disposed along the tear line is with being pinched between the folded film portions. As shown in FIG. 2, both edge portions of the folded film perpendicular to the tear line is are heat-sealed (to form heat seal portions 4). A width of each heat seal portion 4 is selected to 5 mm. In this case, the unsealing thread 2 is also firmly heat-sealed with the heat seal portions 4 to prevent toner from leaking through around the unsealing thread 2. The film 1 may be formed from a laminated layer made of ductile foam polypropylene/EVA group sealant, and a ductile direction of the foam polypropylene layer is selected to be in parallel with the tear line is (shown by the arrow in FIG. 1).

Figure 3:
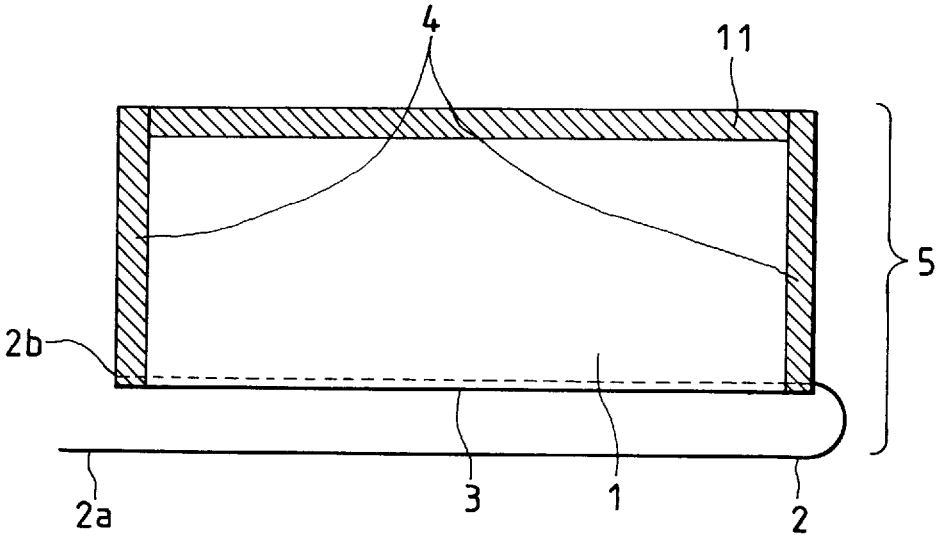
FIG. 3 is a side view of the toner replenishing container according to the first embodiment, after toner is loaded and an opening is sealed.

The film 1 serves to form a bag container 5 and has strength sufficient to satisfy transportation tests and environmental tests as a bag. Further, the film has a tearing ability that a user can easily unseal the bag. According to the illustrated embodiment, in order to provide the tearing ability, the film 1 includes the ductile foam polypropylene layer for easily unsealing the bag. Further, when heat-sealed, the sealant layer constituting an inner layer of the bag container 5 must provide the adequate sealing ability for the bag. In this regard, in the illustrated embodiment, since the inner sealant layers are heat-sealed to each other, high sealing ability can be expected. The unsealing thread 2 has strength sufficient to resist against tearing and extension during the unsealing operation, and heat-resistance to bear the heat in the heat-sealing operation. In the illustrated embodiment, the unsealing thread 2 is formed from a nylon thread having a diameter of 0.2 mm. Since the bag container 5 is opened at its top, the toner is loaded into the bag container through the top opening. Thereafter, the top opening of the bag container 5 is closed, and, then, the closed upper edge of the bag container is heat-sealed (to form a sealed portion 11 as shown in FIG. 3). FIG. 3 shows a completely assembled bag container.

Next, an unsealing operation and a toner replenishing operation will be explained.

Figure 4:
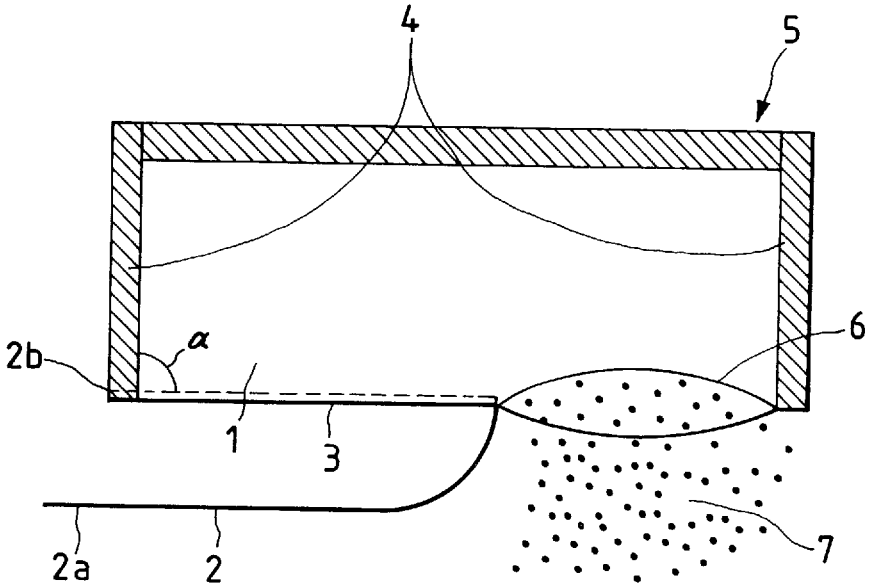
FIG. 4 is a side view of the toner replenishing container according to the first embodiment, showing a condition that the toner is being discharged or supplied on the way.
Figure 5:
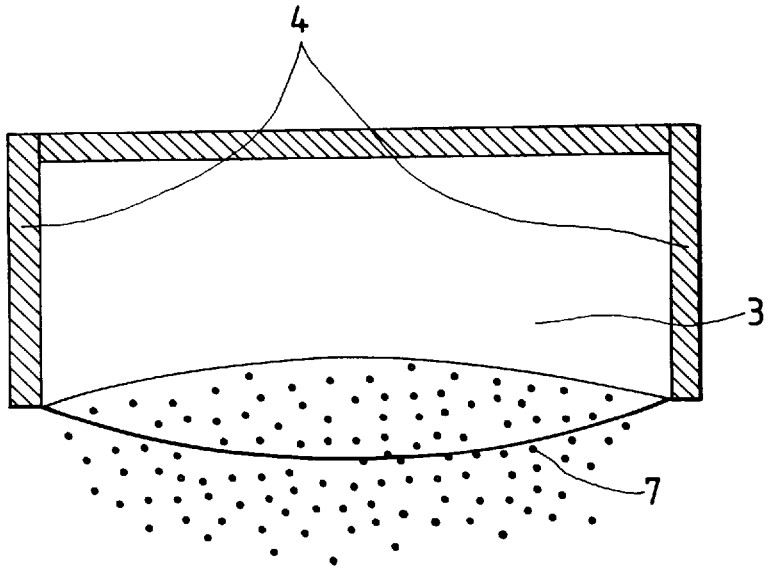
FIG. 5 is a side view of the toner replenishing container according to the first embodiment, showing a condition that the toner is being discharged.

First of all, the bag container 5 is inserted into a developing hopper portion of an image forming apparatus such as a copying machine, a printer and the like and is fixed thereto (not shown). Then, an extended free end 2*a* of the unsealing thread 2 is pulled out of the developing hopper (not shown). As shown in FIG. 4, when the user pulls the extended free end 2*a* of the unsealing thread, the film 1 on the tear line 3 is torn straightly to form an opening 6 in the bag container. As a result, the toner is discharged through the opening 6 of the bag container 5, thereby replenishing the toner into the developing hopper. After the film 1 is torn, the unsealing thread 2 is pulled out of the developing hopper. However, during the unsealing operation, the other end 2*b* of the unsealing thread 2 is secured to the seal portion 4. Accordingly, the fact that only the unsealing thread 2 is pulled out of the container and the film 1 is not torn can be prevented. As mentioned above, since the end 2*b* of the unsealing thread 2 is secured to the seal portion 4, after the unsealing operation of the unsealing thread 2 is completed, as shown in FIG. 5, a bottom of the bag container 5 is completely opened. As a result, all the toner in the bag can be discharged substantially completely. It is important that an angle $\alpha$ between the tear line 3 (bottom opening) and the seal portion 4 is selected to be equal to or smaller than 90° in order to ensure the complete discharge of the toner. If the angle $\alpha$ is greater than 90°, there arises a dead space relative to the bottom opening, with the result that some toner is remained in the dead space. In the illustrated embodiment, the angle $\alpha$ is set to 90°. Incidentally, at the end 2*b* of the unsealing thread, the thread is secured to the seal portion 4 in a folded condition.

Further, the bottom of the bag container 5 becomes a bottom end or lower end when the container 5 was inserted into the developing hopper.

After the toner of 500 grams was loaded in the bag container 5, the toner was replenished to the developing hopper by using this bag container. As a result, it was found that the toner could easily be replenished by the unsealing strength (force applied to the unsealing thread 2 for unsealing the bag container) of about 1 to 2 kgf. Further, in this case, it was found that an amount of the remaining toner was merely 1 gram. Furthermore, after transportation and environmental tests regarding 1000 bag containers 5, it was found that any abnormality was not ascertained.

Incidentally, so long as the aformentioned conditions are satisfied, any materials can be used to manufacture the film 1 and the unsealing thread 2. Further, a diameter and a width of the unsealing thread are not limited to specific ones. Of course, in place of the unsealing thread, any tape members may be used so long as the aforementioned conditions are satisfied.

(Second Embodiment)

Figure 6:
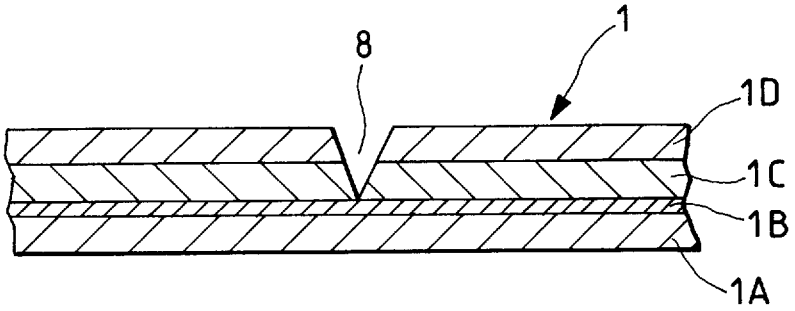
FIG. 6 is an enlarged sectional view of a film laser-processed, according to a second embodiment of the present invention.

A second embodiment of the present invention is similar to the above-mentioned first embodiment, except that a film formed by a laser cut process is used as the film 1. In the second embodiment, in order to improve the tearing ability of the film 1, a portion of the film corresponding to the straight tear line 3 is previously half-cut by laser (carbonic acid gas laser). More specifically, as shown in FIG. 6, in the film 1 comprised of a ductile polypropylene layer 1A, an aluminium layer 1B, a polyester layer 1C and a sealant layer 1D, only the polyester layer 1C and the sealant layer 1D are straightly cut by the laser. In this way, a half cut line (laser cut line) 8 is formed in the film in correspondence to the tear line 3. In the laser cut line 8 (i.e., tear line 3), since only the polypropylene layer 1A and the aluminium layer 1B are remained uncut, the film can easily be torn by the unsealing thread 2.

The other construction of the bag container according to the second embodiment is the same as the first embodiment.

Also in the bag container 5 according to the second embodiment, as a result of the unsealing and replenishing tests, as is in the first embodiment, it was found that the unsealing strength was about 1 to 2 kgf, and, even when a range of the pulling angle of the unsealing thread 2 relative to the tear line is more great, the bag container could easily be unsealed. Further, regarding the transportation and environmental tests, any abnormality was not ascertained.

Figure 7:
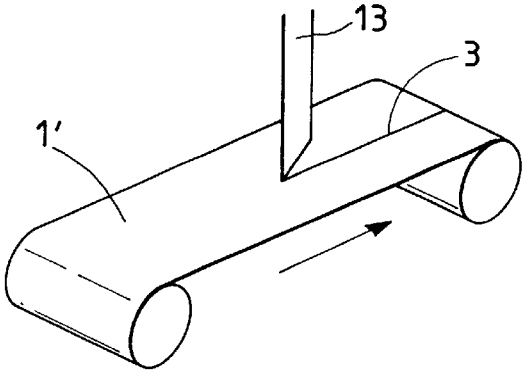
FIG. 7 is a perspective view showing a method for forming a tear portion of the film according to the second embodiment.

Incidentally, as a method for thinning the tear line 3 of the film 1, as shown in FIG. 7, while a (roll-shaped) blank 1' of the film 1 is being rotated in a direction shown by the arrow, the straight tear line 3 (cut line 8) may be formed by a fixed cutter 13. Further, in place of the fixed cutter 13, a rotary cutter may be used.

(Third Embodiment)

A third embodiment of the present invention is shown in FIGS. 8 to 11.

In comparison with the first embodiment, according to the third embodiment, in order to increase an effective volume of a container, there is provided a box-like container having a rectangular bottom.

Now, an assembling procedure of the toner replenishing container according to this third embodiment will be explained.

Figure 8:
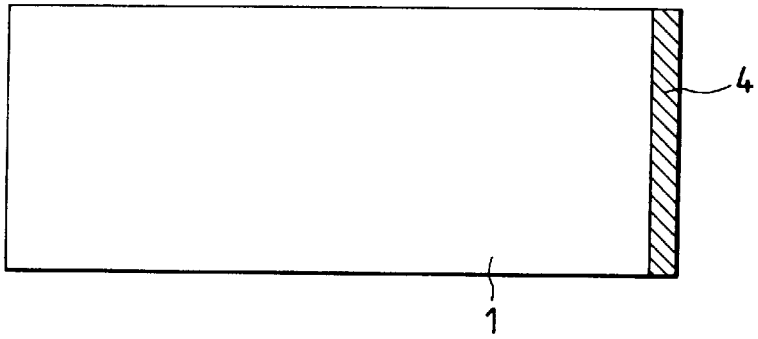
FIG. 8 is a plan view showing a manufacturing step of a toner replenishing container according to a third embodiment of the present invention.

(1) The film 1 used in the first embodiment is cut to a rectangular shape, and the rectangular film is folded into two in a longitudinal direction, and the overlapped longituinal ends are heat-sealed as a seal portion 4 to form a loop film (FIG. 8).

Figure 9:
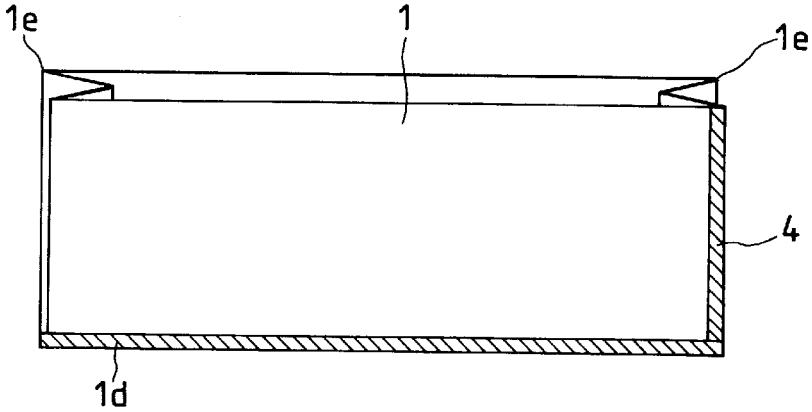
FIG. 9 is a perspective view showing a construction of the toner replenishing container according to the third embodiment.

(2) Then, at both longitudinal sides corresponding to both sides of the toner replenishing bag container to be formed, inwardly directed V-shaped folded portions 1*c* are formed in the looped film (refer to FIG. 9).

(3) Then, bottom edge portions of the film is heat-sealed to form a seal portion 1*d* (FIG. 9).

Figure 10:
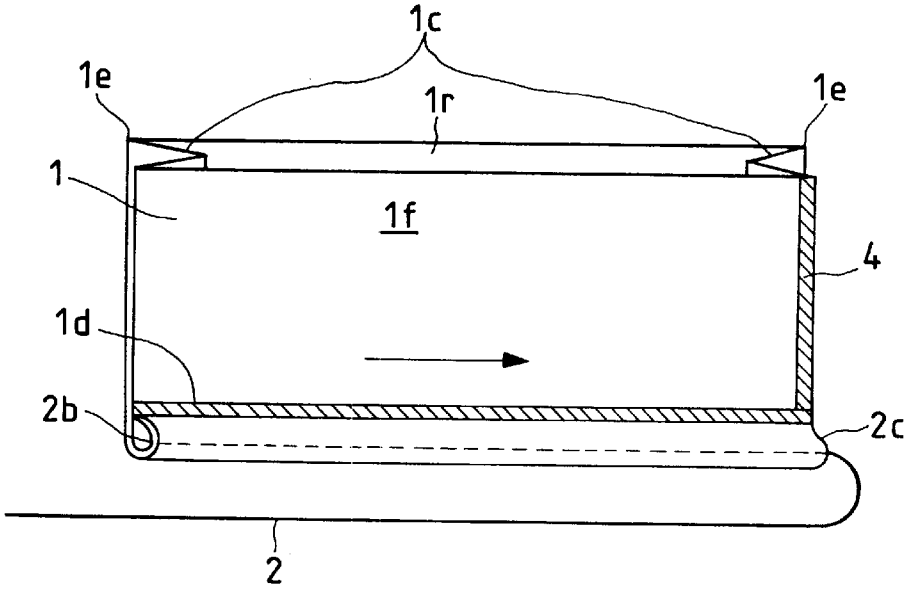
FIG. 10 is a perspective view of the toner replenishing container according to the third embodiment.

(4) Then, the seal portion 1*d* is bent forwardly and then is secured to a front surface of the bag. In this case, the unsealing thread 2 is arranged in the bent loop (FIG. 10). Further, the ductile direction of the film is selected to a direction shown by the arrow (FIG. 10) same as the unsealing direction of the thread 2. The bottom seal portion 1*d* is positively heat-sealed to prevent toner leakage from the bag, and the seal portion 1*d* may be secured to the front surface of the bag to an extent that the unsealing thread is not disengaged from the bag during the unsealing operation. In the illustrated embodiment, the seal portion 1*d* was secured to the front surface by an adhesive tape. Further, the end 2*b* of the thread 2 is secured to the bag so that only the thread is not removed from the bag during the unsealing operation.

Figure 11:
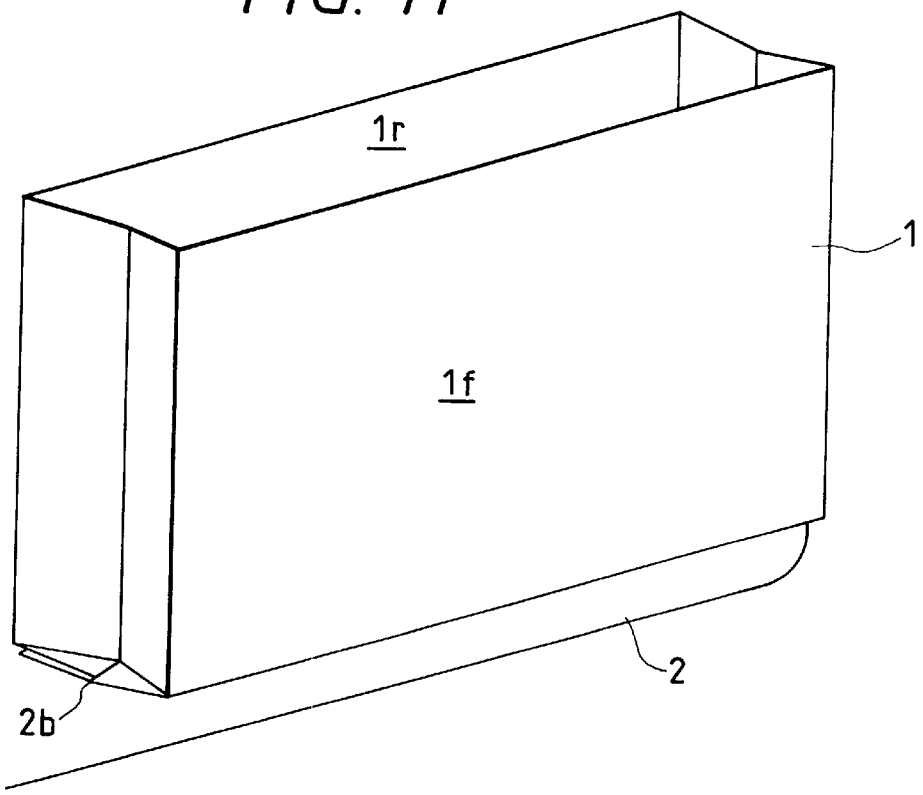
FIG. 11 is a perspective view of the toner replenishing container according to the third embodiment, showing a condition that the container is expanded to a container shape.

(5) Then, the bag is expanded to form a box-like container having an top opening and a rectangular bottom (refer to FIG. 11).

(6) Then, the toner is loaded into the container through the top opening. The toner is loaded as much as possible, with remaining a small upper space for aiding the sealing of upper edges of the container.

Figure 12:
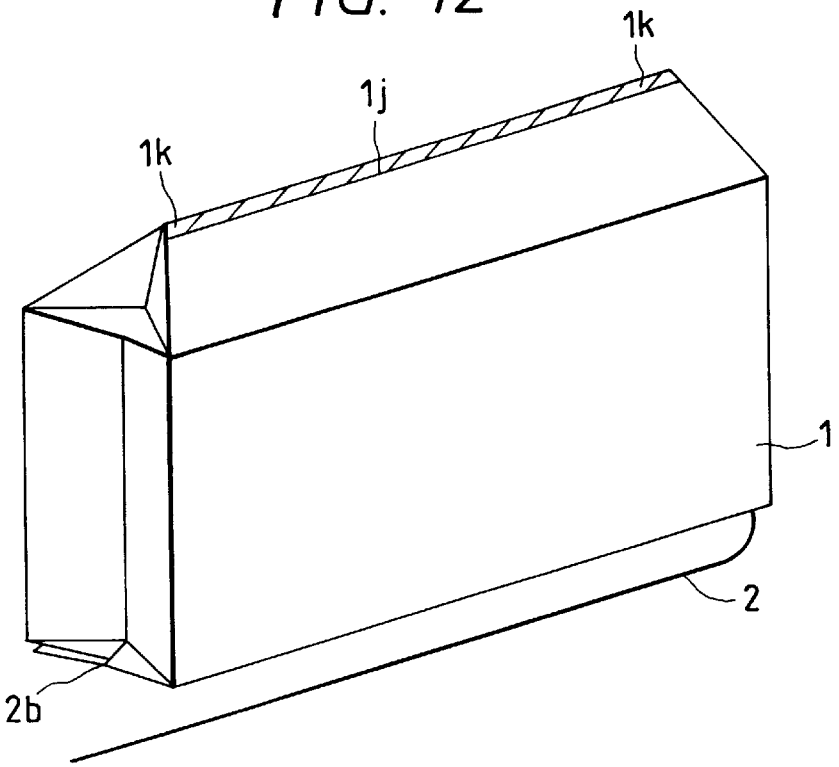
FIG. 12 is a perspective view showing an assembled condition of the toner replenishing container according to the third embodiment.

(7) As is in the bottom, the upper folded portions 1*c* are bent inwardly, and the bent folded portions 1*c* and upper edge portions of the front and rear surfaces 1*f*, 1*r* of the container are overlapped and heat-sealed to form a seal portion 1*j* (FIG. 12). In this case, the upper edge portions of the bent folded portions 1*c* are also heat-sealed as seal portions 1*k* (FIG. 12).

Figure 13:
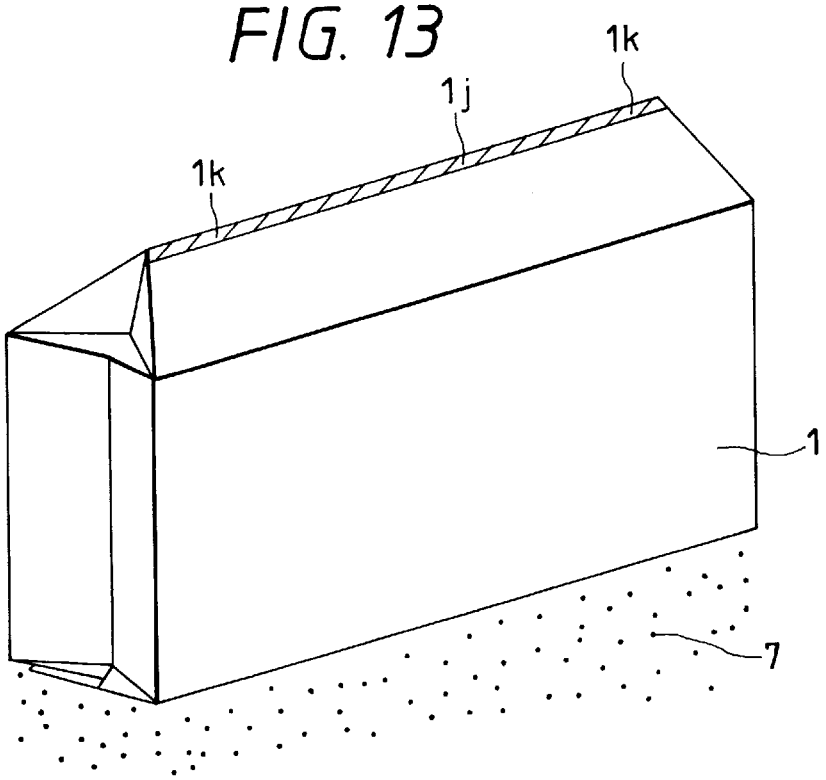
FIG. 13 is a perspective view of the toner replenishing container according to the third embodiment, showing a condition that toner is being discharged.

The toner replenishing container so formed is a so-called prismatic cassette bag having a box-like shape including a bottom surface, front and rear surfaces, side surfaces and a top surface, which can increase an effective volume. In the unsealing operation, when the unsealing thread 2 is pulled to tear the film 1, the bottom folded portions 1*c* are retracted outwardly to completely open the bottom of the container as shown in FIG. 13, thereby discharging the toner 7 effectively.

Regarding the toner replenishing container according to this embodiment, after the toner 7 of 500 grams was loaded in the container, the unsealing and replenishing teats were effected. As a result, the same result as the first embodiment was ascertained. Further, in the transportation and environmental tests, any abnormality could not found.

(Comparison Example 1)

Figure 14:
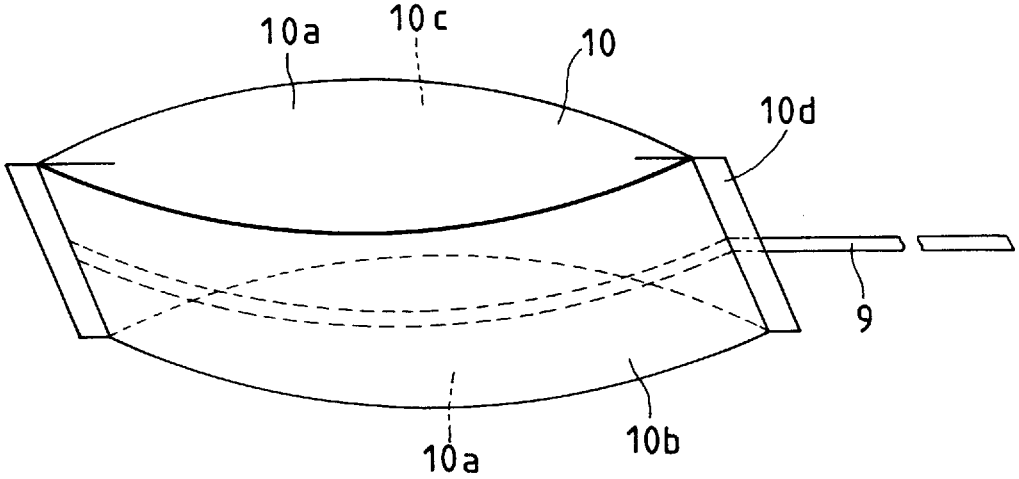
FIG. 14 is a perspective view showing a construction of a toner replenishing container according to a comparison example 1.

FIG. 14 is a perspective view of a toner replenishing container according to a comparison example 1.

As shown in FIG. 14, the toner replenishing container of the comparison example 1 comprises an unsealing tape 9 for unsealing a part of a bottom surface 10*b*, and a bag body 10. Both side surfaces 10*a* of the bag body each has an elliptical shape, and the bottom surface 10*b* and an upper surface 10*c* are uniformly curved (as a portion of a sylindrical surface) having no irregularity. The tape 9 is heat-sealed to an inner side of the bottom surface 10*b* of the bag body 10 so that the bag body 10 can be unsealed by the tape by tearing the bag along the tape. The tape 9 is constituted by a polyester layer, a nylon layer and a sealant layer. The bag body 10 is made of the same material as that in the first embodiment of the present invention in order to improve the tearing ability. The ductile direction of the film is selected to coincide with the tearing direction. Further, a width of the tape 9 is selected to 10 mm, and a width of the bag body 10 is selected to 100 mm.

Figure 15:
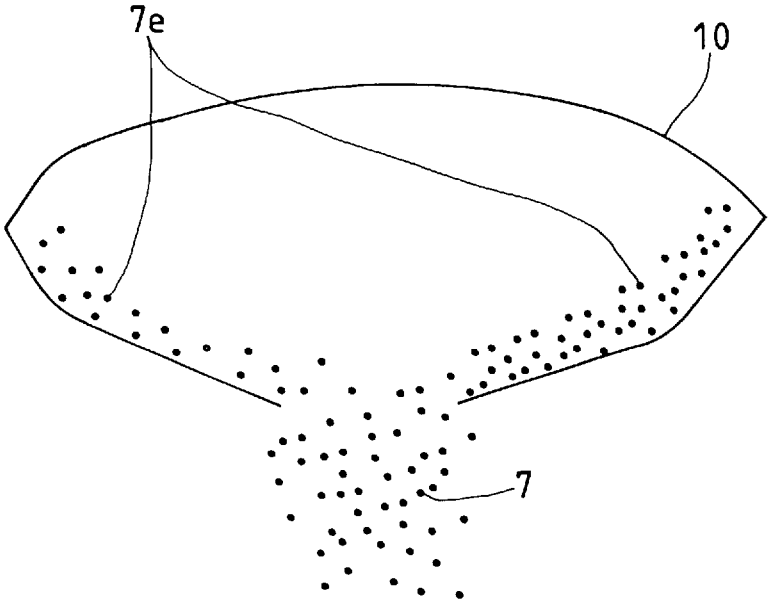
FIG. 15 is a sectional view of the toner replenishing container according to the comparison example 1, showing a condition that toner is being discharged.

After the toner 7 of 500 grams was loaded in the toner replenishing container according to the comparison example 1, the unsealing and replenishing tests were effected. As a result, it was found that, although the unsealing strength was 2 to 4 kgf, the toner discharging ability was worsened (the toner 7*e* of 150 grams was remained in the container as shown in FIG. 15).

In order to reduce the remaining toner 7*e*, if a wider tape is used, the unsealing strength is increased, with the result that it is difficult to unseal the container unless a tip end 10*d* of the bag body 10 is firmly secured to the developing hopper. In fact, when a tape having a width of 60 mm was used, the unsealing strength exceeded 8 kgf. Incidentally, regarding the toner loading, transportation and environmental tests, any abnormality could not ascertained.

According to the aforementioned embodiments of the present invention, the following advantages can be obtained.

(1) The container can easily be unsealed with a small force.

(2) After the unsealing operation, since the bottom of the bag is completely opened not to prevent the discharge of toner, the toner can be discharged effectively.

(3) Since the container can be formed from only two parts (film and thread), low cost can be expected.

(4) Since the used container can be discarded with small volume (by folding the container to become a small volume), the disposed space can be saved and ecology can be improved.

(5) By using the unsealing thread or tape, the unsealing operation can be facilitated, and, since the free end of the unsealing thread can easily be extended out of an image forming apparatus having the developing hopper (into which the toner is replenished from the toner replenishing container), the container can easily be applied to such image forming apparatus.

(6) Since the film has one or more layers having the unidirectional ductile ability and the ductile direction coincides with the tearing direction, the bottom of the bag can easily be unsealed.

(7) By thinning the tear line along which the film is torn, even when the unsealing member is pulled along a direction different from the tear line more or less, the desired unsealing condition can easily be achieved.

(8) By thinning the tear line by the laser cut process, the correct tear line or cut line can be obtained.

(9) By providing the rectangular bottom in the bag, the toner containing volume of the toner replenishing container can be increased.

What is claimed is:

1. A toner replenishing container, comprising:

a bag made of a film; and an opening member for completely opening said bag by tearing said bag unidirectionally along a length of said bag;

wherein after opening, a bottom of said bag is completely opened.

2. A toner replenishing container according to claim 1, wherein said opening member is a thread or a tape.

3. A toner replenishing container according to claim 1, wherein the film has at least one layer having a unidirectional ductile ability, and a ductile direction thereof coincides with a tearing and opening direction of said opening member.

4. A toner replenishing container according to claim 1, wherein a tear line of the film is thinned.

5. A toner replenishing container according to claim 4, wherein the thinned tear line is formed by a laser cut process.

6. A toner replenishing container according to claim 1, wherein a bottom of said bag has a substantially rectangular shape.

7. A toner replenishing container for replenishing a toner to an apparatus, comprising:

a flexible bag provided with a folded at one end and folded at another end thereof, respectively; and an opening member provided at a folded portion extending between the one end and the other end, said opening member being secured to the one end and passing through the folded portion and through the other end for opening said bag;

wherein said opening member completely opens in a direction to tear said bag unidirectionally.

8. A toner replenishing container according to claim 7, wherein said opening member is a thread or a tape.

9. A toner replenishing container according to claim 7, wherein the film has at least one layer having a unidirectional ductile ability, and a ductile direction thereof coincides with a tearing and opening direction of said opening member.

10. A toner replenishing container according to claim 7, wherein a tear line of the film is thinned.

11. A toner replenishing container according to claim 10, wherein the thinned tear line is formed by a laser cut process.

12. A toner replenishing container according to claim 7, wherein a bottom of said bag has a substantially rectangular shape.

* * * * *

UNITED STATES PATENT AND TRADEMARK OFFICE

CERTIFICATE OF CORRECTION

PATENT NO. : 5,832,349
DATED : November 3, 1998
INVENTOR(S) : Toshiaki Nagashima It is certified that error appears in the above-identified patent and that said Letters Patent is hereby corrected as shown below:

Column 2
Line 40, "line is" should read -- line 3 --;
Line 43, "line is" should read -- line 3 --; and
Line 52, "line is" should read -- line 3 --.

Column 4
Line 52, "is" should read -- are --.

Column 5
Line 2, "an" should read -- a --;
Line 29, "not" should read -- not be --; and
Line 65, "not" should read -- not be --.

Column 6
line 56, "folded" should read -- fold --.

Signed and Sealed this

Twenty-first Day of August, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,832,349
DATED : November 3, 1998
INVENTOR(S) : Toshiaki Nagashima It is certified that error appears in the above-identified patent and that said Letters Patent is hereby corrected as shown below:

Title page,
Item [73] should read as follows:

-- Canon Kabushiki Kaisha --.

Signed and Sealed this

Sixth Day of November, 2001

*Attest:*

Nicholas P. Godici

*Attesting Officer*

NICHOLAS P. GODICI
*Acting Director of the United States Patent and Trademark Office*